US005676306A

United States Patent [19]

Lankin et al.

[11] Patent Number: 5,676,306

[45] Date of Patent: Oct. 14, 1997

[54] FOLDABLE LOCKING LID FOR A CONTAINER

[75] Inventors: Kevin Lankin, Stroud; Genny Spoenlein, Barrie, both of Canada

[73] Assignee: Ros-Dan Improved Product Design Ltd., Barrie, Canada

[21] Appl. No.: 527,450

[22] Filed: Sep. 13, 1995

[30] Foreign Application Priority Data

Mar. 3, 1995 [CA] Canada ..... 2145112

[51] Int. Cl.[6] ..... B65D 3/10

[52] U.S. Cl. ..... 229/404; 229/5.5; 229/138; 229/906.1

[58] Field of Search ..... 229/103.1, 106, 229/109, 110, 116.1, 138, 404, 5.5, 906.1; 493/156–159, 183

[56] References Cited

U.S. PATENT DOCUMENTS

| | | | |
|---|---|---|---|
| D. 270,042 | 8/1983 | Fisher | D9/430 |
| D. 272,130 | 1/1984 | Miyazaki | D9/431 |
| 657,473 | 9/1900 | Wagnitz | 229/138 |
| 2,013,691 | 9/1935 | Martinson | 65/16 |
| 2,047,804 | 7/1936 | Shapiro | 229/138 |
| 2,091,291 | 8/1937 | Ringler | 229/138 |
| 2,160,488 | 1/1939 | Ringler | 229/5.5 |
| 3,232,480 | 2/1966 | Stanley | 229/138 |
| 3,423,008 | 1/1969 | Mykleby . | |
| 3,549,081 | 12/1970 | Nelson | 229/117 |
| 3,768,720 | 10/1973 | Bundy | 229/138 |
| 3,833,113 | 9/1974 | Osier | 206/4 |
| 4,185,767 | 1/1980 | Sykora et al. . | |
| 4,260,101 | 4/1981 | Webinger . | |
| 4,705,209 | 11/1987 | Fujihara et al. | 229/109 |
| 4,712,725 | 12/1987 | Moore | 229/404 |
| 4,795,082 | 1/1989 | Fujihara et al. | 229/109 |
| 4,850,528 | 7/1989 | Hanus | 229/138 |
| 4,930,680 | 6/1990 | Hanus | 229/138 |

FOREIGN PATENT DOCUMENTS

| | | | |
|---|---|---|---|
| 855070 | 11/1970 | Canada | 229/110 |
| 58091 | 8/1946 | Netherlands | 229/5.5 |
| 2221897 | 2/1990 | United Kingdom | 239/138 |

*Primary Examiner*—Gary E. Elkins

*Attorney, Agent, or Firm*—Jeffrey T. Imai; D. Doak Horne; Arne I. Fors

[57] ABSTRACT

A closure for a container such as a paper cup. The container has an extended upper border having a series of crease lines extending downwardly from an upper edge, which when folded inwardly form a series of rectangles, each having a diagonal corner portion to form a closure panel. The panels may be displaced inwardly of the border in a mutually overlapping relation to close the container. By selecting a fold-over angle greater than neutral, the panels will converge in a mutual reactive relation to converge and lock in an inclined closure cone. The crease lines incorporate an adjoining reinforcing band to fold over within the upper border to form a reinforced band therearound. The containers are stackable when in an unfolded or partially unfolded condition.

24 Claims, 5 Drawing Sheets

FOLDABLE LOCKING LID FOR A CONTAINER

FIELD OF THE INVENTION

This invention is directed to a foldable closure or lid for a container, and a container having an integral foldable closure or lid. In particular this invention relates to an integral, lockable folding closure, suitable for use with or as a part of a container for beverages, other consumables, or other products.

BACKGROUND TO THE INVENTION

The catering industry makes widespread use of disposable cups such as paper and polystyrene drinking cups, for which a wide variety of removable plastic lids have been evolved. The use of plastics for such purposes is meeting much opposition, on grounds of their unsuitability for disposal, their slow degradability, and as a waste of non-renewable resources.

In addition to adverse public reaction on environmental issues, such removable lids also suffer from certain practical drawbacks. These include:

1) the necessity of having a stack of cups and a separate stack of lids at the serving point;
2) difficulty in readily, consistently and rapidly applying the lid in sealing relation to the cup brim; and
3) susceptibility of the lid to damage.

The difficulty in achieving a consistent sealing fit between cup and lid, can result in leakage or even the loss of the lid from a filled cup, with possible major spillage, for instance, when driving in a car.

In terms of recycling component parts made from different materials, namely paper and plastic, it is necessary to separate the components after use in order to enable effective recycling. Such separation is bothersome and time-consuming and can prove to be difficult.

Due to the close tolerances to which plastic lids are necessarily manufactured in order to provide a sealing fit, and the thin-ness of the plastic lids, the nested lids have a tendency to stick together, and frequently are tedious and time consuming to separate. Occasionally two lids in tight nested relation are accidentally used as one.

In the prior art, U.S. Pat. No. 4,930,680, issued Jun. 5, 1990, of Hanus, shows a one piece container of hexagonal shape, the blank for which requires extremely complex creasing, and wherein the folded wall panels require to be glued together in order that the top panels when folded inwardly into engagement do not cause bulging, distortion and separation of the package walls. This glueing operation necessitates the application of glue to at least six separate points. For purposes of stacking, there exist six double-thickness triangular corner flaps, giving triple thickness at the respective corners, within the container periphery. The corner flaps significantly increase the stack height for a given number of containers, as compared with a container such as a paper cup having a single seam of double thickness. The seams are not usually in precise, mutual, overlying registry.

Certain other aspects of foldable closures will be found in the following U.S. Pat. Nos. 2,013,691, Martinson, September 1935, 2,160,488, Ringler, May 1939, 3,423,008, Mykleby, January 1969, 3,833,113, Osier, September 1974, 4,185,767, Sykora, January 1980, 4,260,101, Webinger, April 1981, Des. 270,042, Fisher, August 1983, Des. 272, 130, Miyazaki, January 1984, 4,705,209, Fujihara, November 1987, 4,795,082, Fujihara, January 1989.

DISCLOSURE OF THE INVENTION

The present invention provides a closure for a container. The closure comprises an elongated strip of substantially planar material. One elongated edge thereof has a border traversed by a plurality of crease lines to form a plurality of adjoining rectangular panel elements. Each of the panel elements has an oblique crease line parting off a minor, substantially triangular, intermediate edge element. The crease lines permits the folding over of each edge element in overlying relation with the respective adjoined panel element of which it forms a part, to thus draw the adjoining rectangular panel in correspondingly cranked, overlapped relation with the underlying panel. The opposed ends of the strip each has a seam allowance, which when secured in predetermined mutual overlapping relation forms an open ended tube, one end of which may be closed by folding of the respective edge elements in folded-over relation with the adjoined panel element. The folded panel elements when folded inward in mutual overlapping relation and pressed inwardly past the dead centre position are resiliently collectively locked in place in substantially enclosing relation with the tube.

The width of the transversely creased border of the strip is sensibly equal to the radius of the open ended tube at its line of closure. The respective infolded panels being brought into mutual deforming relation, so as to remain in stable locked relation when compressed past the dead centre position.

The elongated strip forming the aforesaid enclosure may have straight, parallel longitudinal edges, in which case the joining of the opposed ends will produce a right cylinder, for which the folded panel will provide a closure.

Where the elongated strip has arcuate longitudinal edges, the joining of the ends thereof will produce a frustum or a cone, depending on the geometry of the strip.

In the case of a frustum, the thus formed wall may be that of a paper cup, having a bottom in sealed relation therewith, whereby the folded border will serve as a top closure or lid to the cup.

Where the strip comprises a segment of a circle, the fastening of the radial edges in overlapping relation forms a cone, having the subject readily openable closure located at its open end, and being useful as a container for candies, etc., or for frozen delicacies such as ice cream.

A longitudinal crease line may be provided along the length of the strip to form a narrow, inextensible inner band adjoining the panel elements, which band is foldable downwardly within the tube end, to reinforce the periphery of the closure, while forming a distinct lip; also, the inner band, when folded, serves to locate the closure elements below the lip, and in recessed relation within the end of the tube, as a depressed, shallow cone. A pull-tab portion may be provided extending outwardly from one of the closure elements, to facilitate the re-opening of the closure elements, by pulling it upwardly from the locked, inwardly coned position, to an upwardly inclined, semi-open or open condition. However, in the case of a closure with large panel elements, such as a hexagonal closure on a standard size paper cup, the greater size of the panel elements obviates the need to provide such a pull-tab, as the folded panel itself can serve that role.

A further difference of a six-panel closure, as compared with a twelve-panel closure is that almost hermetic sealing is obtainable at the "depressed apex" centre of the downwardly folded six-panel closure, probably due to the reduced congestion of panels at that point. This characteristic improves the suitability of the container and closure for certain uses, including packaging substances other than comestibles, such as washing powder and the like.

A suitable aperture perforation, or an aperture in one of the panel elements may be provided as access through the lid closure for a drinking straw. Also, the contents of the cup may be consumed in normal fashion when in its folded-in condition, using the "straw" aperture. The inwardly depressed, shallowly conical closure elements facilitate such use as a drinking cup.

In the case of a 12-sided closure, the depressed apex or centre of the closure provides a restricted air breather aperture, to enable smooth delivery of the liquid contents to the person drinking. It also may serve as a drain-back aperture to the concavity, in the event of any slight spillage. In the absence of a straw aperture the subject container/cups may also be used in the fully open condition, with the lid elements unfolded. In such use, the capacity of the container/cup is substantially greater, suiting it for use as an open topped container for a larger volume product such as a milk-shake or other open-top drink, or for pop-corn, french fries, etc.

The subject lid's optional, inextensible, rim-forming skirt portion provides reinforcement for the peripheral restraint and reactive forces that facilitate locking interaction between the folded panel elements, upon closure.

In addition to reinforcing and rigidifying the lid when in its folded-in condition, the doubled rim portion also forms, in combination with the other lid elements a tray-like recess within which the base of a like cup can stand, in semi-nested, supported relation. This enables a user to carry two filled cups in one hand, in stable stacked relation.

The peripheral boundary crease line for the closure panels, instead of being a straight line or a continuous arc, may be of scalloped form, the radius of each panel scallop line being that of the container or cup, at the boundary line, such that the panels merge at their outer periphery with the wall of the cup, so as to obviate the formation of a multi-sided brim or lip portion, and provide a more conventionally shaped smooth, circular rim.

The oblique crease lines may originate within and thus overlap the above-described inner band which forms the lip, being however inclined at a similar angle to the above described oblique crease lines.

For any closure having a given number of panels, the "neutral angle" by which a stress-free, non-locking closure is generated may be readily determined. The angle of the oblique crease line is equal to one half of 360/N degrees, wherein N is the number of closure panels. Thus, for a 12 panel closure, the "neutral angle" equals 360/(2×12) . . . i.e. 15 degrees. By making the oblique crease angle slightly greater, say 17 degrees, then a stress load is created in the adjoining panels when forced into a closure-forming position, such that when pushed inwardly past the dead-centre position, the panels are brought into mutually locking relation, and require the application of an opening force to overcome the locking force. The angular increase above the "neutral angle" may exceed about two degrees, to as much as about five degrees. In some instances the higher angle values may prove excessive, for acceptable locking.

It will be understood that certain of the crease lines may lie in one direction of bending, while others lie in the reverse direction. As a for-instance, the panel crease bends for a cup closure having a lip, with a correspondingly recessed closure will be opposite in direction to those for a flush-ended, lipless closure.

One solution to simplify the creasing operation is to employ the known expedient of providing intermittently pierced crease lines, thereby enabling panels to be bent in either direction. For plastic materials having live hinge creases, this problem does not arise.

BRIEF DESCRIPTION OF THE DRAWINGS

Certain embodiments of the invention are described by way of illustration, without limitation of the invention thereto other than as set forth in the accompanying claims, reference being made to the accompanying drawings, wherein:

DETAILED DESCRIPTION OF THE INVENTION

Figure 1:
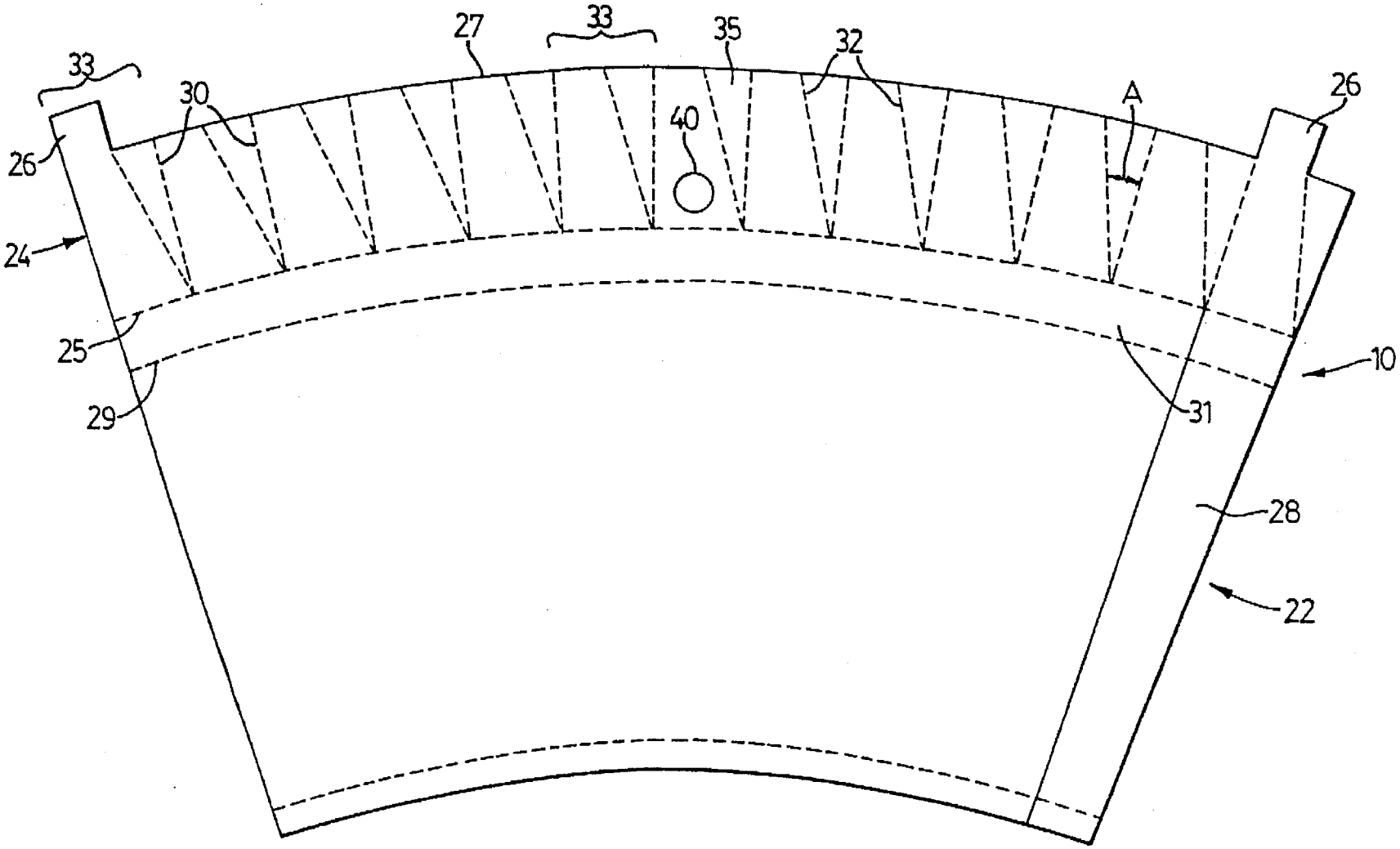
FIG. 1 shows a closure blank for a cup-closure or lid, incorporated a lip, in accordance with the present invention, having score lines for the bending thereof shown dotted.

Referring to FIG. 1, a blank 10 is shown as a planar elongated arcuate strip 22 having a border portion 24 which comprises the closure, delineated by a score line 25. The score line 25 is parallel with the outer edge 27 of the strip 22. A second parallel line 29 defines an inner band 31 that creates a rim, and serves to reinforce the closure.

A pair of tab portions 26 may extend outwardly from the edge 27 of the strip 22.

The strip 22 has a seam allowance 28 at one end which is preferably attached by gluing or bonding in overlapping relation with the opposite ends of the strip 22. In the illustrated embodiment, the strip 22 is shown as being an arcuate segment, whereby the gluing of the seam allowance 28 upon a like seam allowance at the opposite end of the strip 22 produces a frustum. (See FIGS. 2 and 3).

In the illustrated embodiment the strip 22 is shown as having crease lines 30 which define thirteen rectangularly shaped panels 33, which provides twelve panels, after making the seam.

The panels 33 each have an oblique crease 32, illustrated as being a triangulation crease extending upwardly from the bottom right-hand corner, to define triangular edge elements 35 and the complementary panel portions 37.

It can be seen that in the illustrated embodiment the apex angle "A" of the triangle is substantially 17 degrees. This angle may be varied somewhat, but has been found, within the range of 16 to 20 degrees, to apparently yield the best results, in the case of the paper from which the closure is formed.

It can be seen that if the angle "A" were to be 15 degrees, a 30 degree (external angle) deformation is generated at the base circle chords, between adjacent rectangles, when folded, so as to provide a "neutral" i.e. non-stressed closure. By making the angle "A" 17 degrees a 34 degree external angle is generated between adjoining base circle chords. When folded to a "neutral", unstressed condition the panels are in a shallow conical formation, before the dead-centre position. When pushed downwardly past the dead centre position the panels generate an upward force that holds them in a stable, substantially locked condition that requires an opening force to be applied in order to move the closure elements past the dead-centre position. This force may be applied by way of the pull tab 26.

Figure 2:
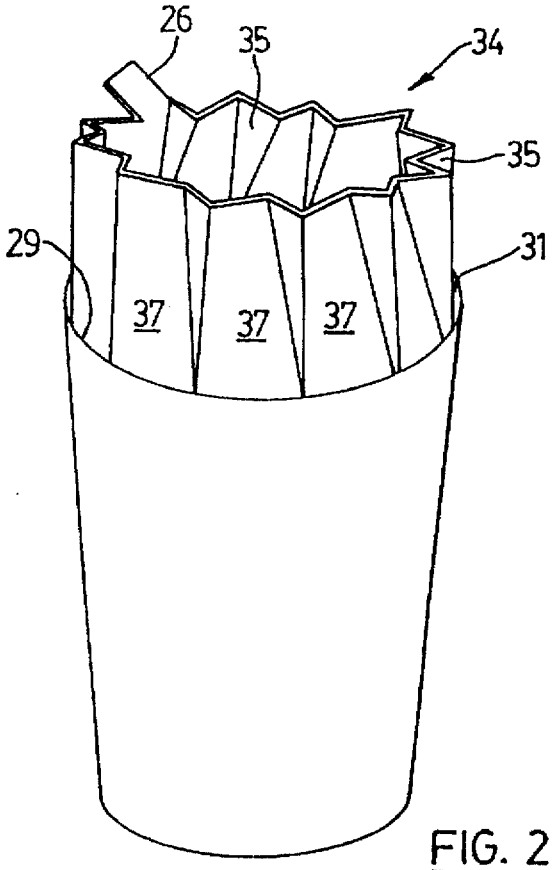
FIG. 2 is a perspective view from above showing the blank of FIG. 1 assembled in tubular form, with the creases of the closure shown in partially folded condition.

Referring to FIG. 2, the integral lid 34 is shown, having the inner band 31 in an infolded position, and the score lines partially folded. The container seam allowance 28 is glued or otherwise bonded in overlapped relation with the opposite edge of the strip 22, thereby uniting the two tab portions 26. The score line 29 now defines a lip to the container.

Figure 3:
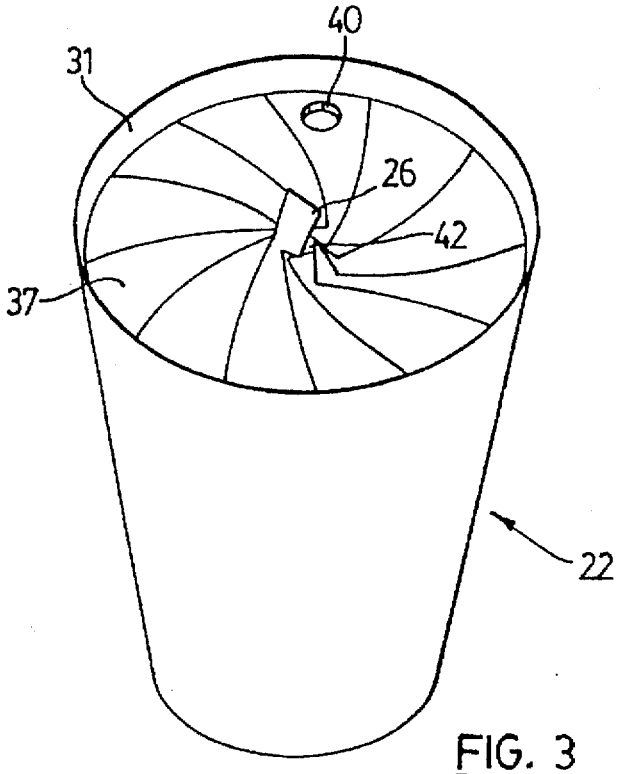
FIG. 3 is a view similar to FIG. 2, showing the closure in a closed condition.
Figure 4:
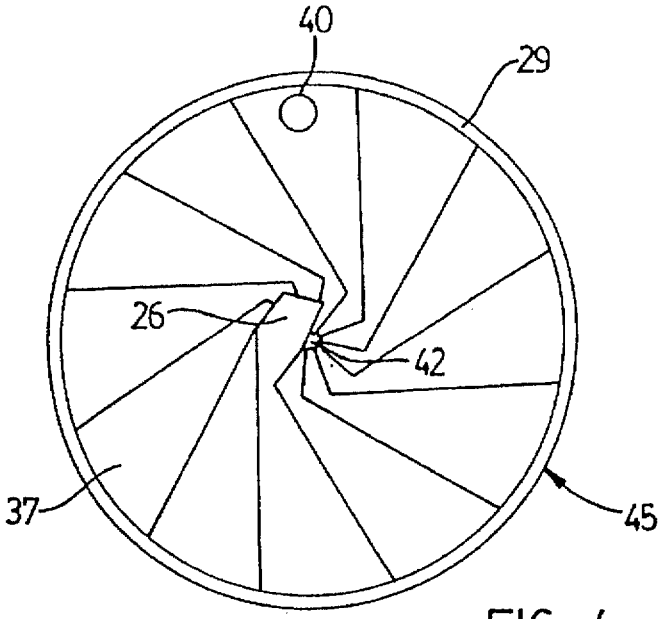
FIG. 4 is a plan view of the FIGS. 2 and 3 embodiment in the fully closed condition.

Referring to FIGS. 3 and 4, the elements of the closure 24 are all folded in, into mutual overlying relation.

A straw aperture 40 is shown, and the interference of the panels forms a central air vent 42 for the container 45.

Figure 5:
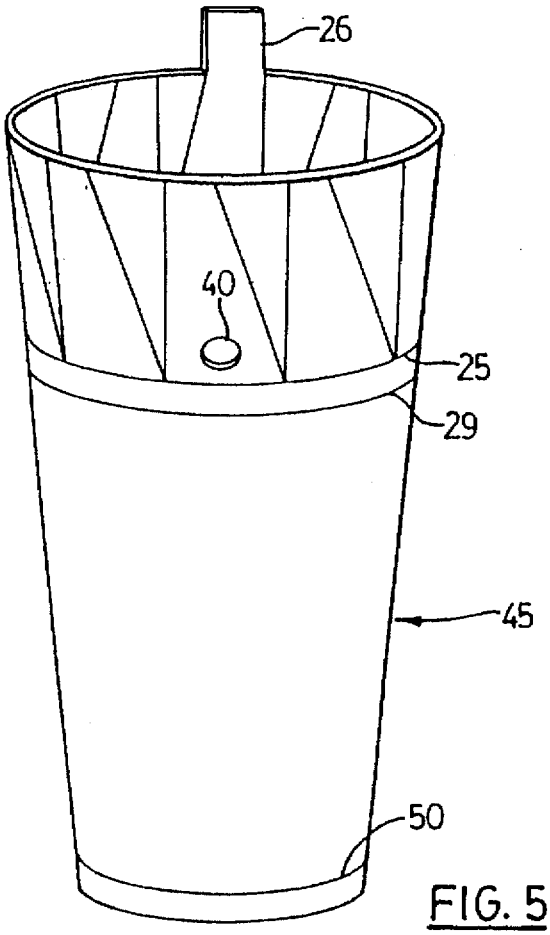
FIG. 5 is a side perspective view of a cup embodiment, having a bottom closure provision, and with the top closure panels undeformed, in a stacking mode.

Referring to FIG. 5, the addition of a bottom score line 50 provides for the attachment of a recessed bottom closure, not shown.

Figure 6:
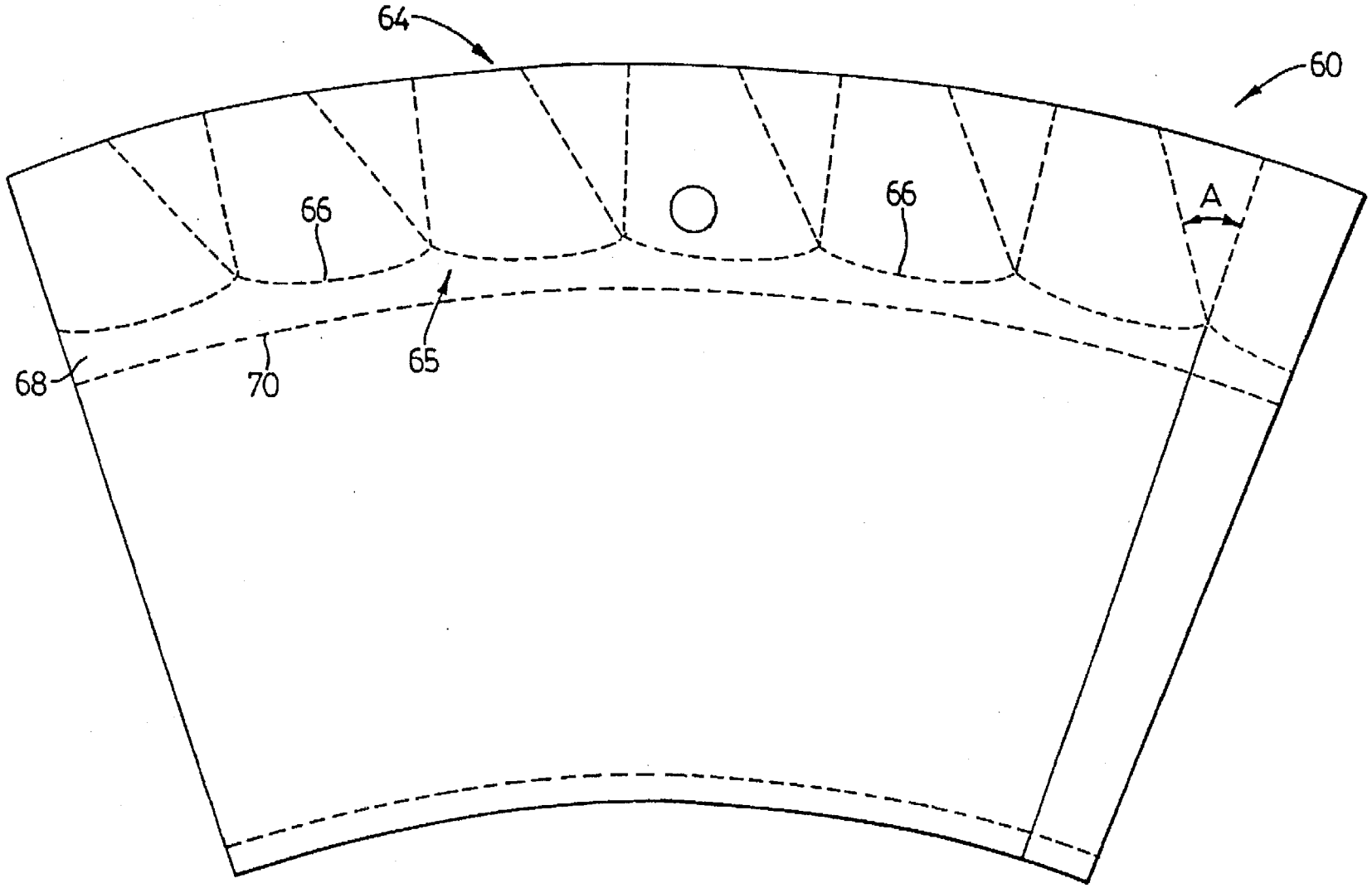
FIG. 6 is a view similar to FIG. 1 of a blank for a six-panel closure, having scalloped panel base lines.

Referring to FIG. 6, the blank 60 is illustrated as being an arcuate strip, as for a frustum shaped closure skirt, or for a cup. A border portion 64 comprises a scored panel base line 65 which comprises six scalloped panels 66, bounded by an adjoining lip band 68. The lip band 68 is defined by the score line 70, which line 70 defines the lip per se.

The radius of curvature for the scallop lines 66 is determined by measuring the radius of the frustum in a plane located inwardly of the lip a distance equal to the maximum width of the lip band 68.

For the six-panel closure 70, the one sixth portion of the periphery subtended by each panel has an included angle of 60 degrees, so that the "neutral" overlap angle for each panel is 30 degrees. The actual triangulation angle selected is approximately two degrees greater, namely 32 degrees. This has been found to require an acceptable panel closure force, thereby generating a corresponding restoration force, when the closure is pushed inwardly past the dead centre position, to provide an effective, locked closure.

In the case of a container of 10-ounce drinking cup size, as illustrated, the panel size is sufficiently large as to suffice for opening tabs, thereby removing the need for pull tabs, with consequent savings in cutting discard for the blank.

The larger panel size resulting from the selection of a smaller number of panels provides improved stability of the closure when used with hot liquids, such as coffee. While the oblique corner fold-over is illustrated as being precisely triangular, a sort fourth side may be included therewith, without impeding the required locking function, (See FIG. 7).

Figure 7:
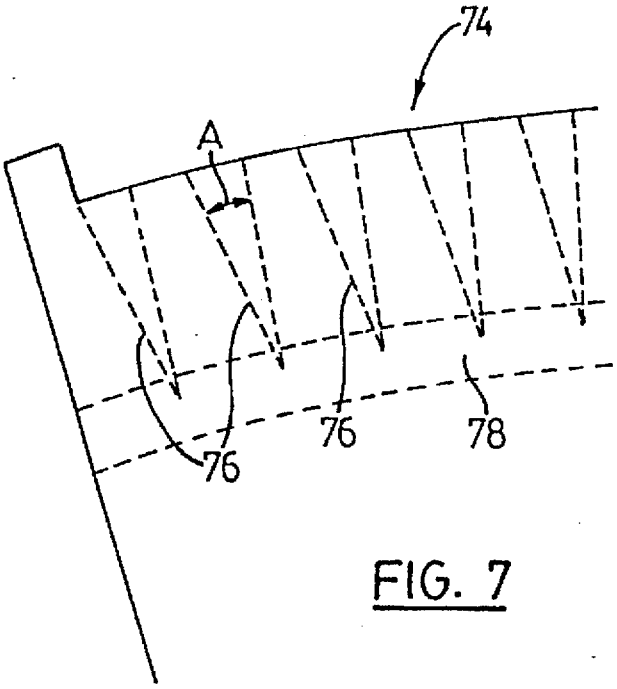
FIG. 7 shows a portion of a blank having a lip-band, and with the oblique crease lines overlapping the lip-band.

Referring to FIG. 7, the portion 74 of a 12-panel closure has triangulation crease lines 76 extending from within the inner band 78 that forms the closure lip.

The triangulation angle "A" is shown as being 17 degrees, the same as for the FIG. 1 embodiment.

Figure 8:
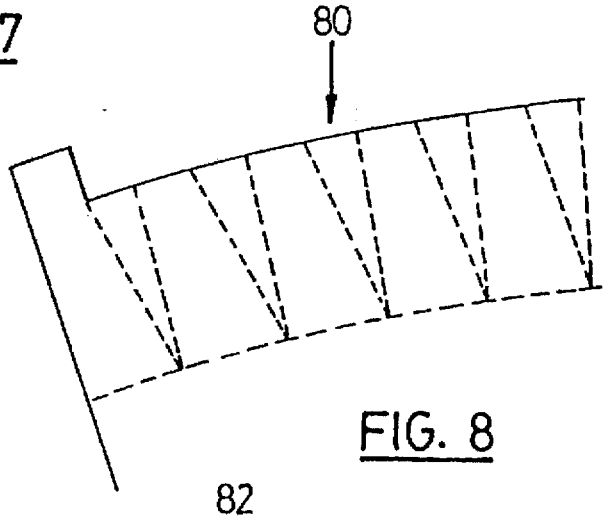
FIG. 8 shows a portion of a blank for a flush-ended, lipless enclosure.

In the FIG. 8 embodiment the portion 80 is that of a flush-ended, lipless closure, there being no lip-band provided therein. It will be understood that in the closed, locked condition the closure elements will occupy the slightly inwardly conically depressed condition best seen in FIG. 9.

Figure 9:
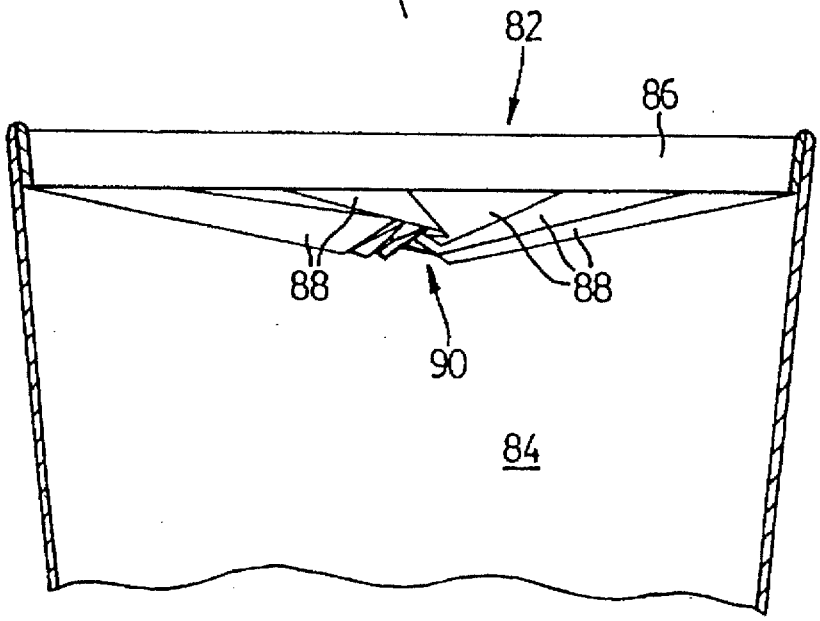
FIG. 9 is a diametrical section of a closure portion for a container in accordance with the present invention.

Referring to FIG. 9, the portion 82 of a closure has a frustum-shaped wall portion 84, and a lip-band 86 with closure panels 88 infolded into mutual locking relation, as shown, hinged from the lip-band 86. The panels 88 form a shallow, inwardly depressed cone, having a central air vent aperture 90 at its apex, referred to above in relation to the FIGS. 3 and 4.

The use of thermoplastic materials is contemplated, wherein the crease-lines may comprise live hinges, such that a permanent, re-usable container or cup may be obtained. At the same time, the homogeneous item may be readily recycled.

The subject closure, by virtue of the lip formed for the container, and by the inward, centrally depressed panels when in the locked position, provides a drinking zone having a reservoir formed by the lip onto which the liquid can flow from the access hole, and an improved facial zone, in use to better accommodate the nose of the drinker, for facilitated drinking. While the subject closure has been illustrated in a six panel form and in a twelve panel form, as few as four panels and a number greater than twelve panels may be employed, in accordance with the desired characteristics of the container and its closure.

INDUSTRIAL APPLICABILITY

This product holds promise of being widely adopted in the catering industry, with other potential commercial and marketing uses, and is ecologically effective.

What is claimed:

1. A closure for a container, the closure comprising an elongated arcuate strip of substantially planar material having opposed ends and elongated parallel edges, the opposed ends being joinable in a mutual overlapping relation; one of said elongated edges has a border having a first crease line extending substantially parallel to said edges, a plurality of crease lines extending perpendicular thereto and extending to the one of said elongated edges defining a plurality of adjoining panels, each of said adjoining panels having an oblique crease line extending from the first crease line and one of the perpendicularly extending crease lines, parting off a triangular edge element, said border has a second crease line extending substantially parallel to said first crease line defining a narrow inner band adjoining said panels, said second crease line defines a reinforced lip about a mouth of said container when said border is folded inwardly and outwardly about said second and first crease lines, respectively, said panels being recessed from said mouth and foldable and unfoldable simultaneously over each other between an open condition, wherein like containers an nestable, and a closed condition, wherein said panels, upon being pressed inwardly, collectively lock in place.

2. The closure as claimed in claim 1 wherein said triangular edge element has an apex angle which exceeds a neutral, stress-free closure angle.

3. The closure as claimed in claim 1 wherein said closure has N panels, wherein N is an integer number, and said triangular edge element has an apex angle of 360/(2N)+X, wherein X is in the range of about 2° to 5°.

4. The closure as claimed in claim 3 wherein said border has a pull tab extending from the one edge of the strip to facilitate opening of the closure.

5. The closure as claimed in claim 3 wherein said border has an aperture for receiving a straw.

6. The closure as claimed in claim 3 wherein N is between 6 and 12, inclusive.

7. The closure as claimed in claim 6 hereto X is 2°.

8. The closure as claimed in claim 3 wherein said panels are sized such that when said panels are folded to said closed condition, a central aperture is presented.

9. The closure as claimed in claim 8 wherein said panels are sized such that when said panels are infolded to said closed condition, said container is substantially sealed.

10. A container comprising an elongated arcuate strip of substantially planar material having opposed ends and elongated parallel edges, the opposed ends being joinable in a mutual overlapping relation, one of said elongated edges engaging a sealing closure, an opposite one of said elongated edges having a border having a first crease line extending substantially parallel to said edges, a plurality of crease lines extending perpendicular thereto and extending to the one of said elongated edges defining a plurality of adjoining panels, each of said adjoining panels having an oblique crease line extending from the first crease line and one of the perpendicularly extending crease lines, parting off a triangular edge element, said border has a second crease line extending substantially parallel to said first crease line defining a narrow inner band adjoining said panels, said second crease line defines a reinforced lip about a mouth of said container when said border is folded inwardly and outwardly about said second and first crease lines, respectively, said panels being recessed from said mouth and foldable simultaneously over each other and unfoldable between an open condition, wherein like containers are nestable, and a closed condition, wherein said panels, upon being pressed inwardly, collectively lock in place.

11. The container as claimed in claim 10 wherein said container has N panels, wherein N is an integer number, and said triangular edge clement has an apex angle of 360/(2N) +X, wherein X is in the range of about 2° to 5°.

12. The container as claimed in claim 11 wherein said border has a pull tab extending from the one edge of the strip to facilitate opening of the closure.

13. The container as claimed in claim 11 wherein said border has an aperture for receiving a straw.

14. The container as claimed in claim 11 wherein N is between 6 and 12, inclusive.

15. The container as claimed in claim 14 wherein X is 2°.

16. The container as claimed in claim 15 wherein said panels are sized such that when said panels are infolded to said closed condition, a central aperture is presented.

17. The container as claimed in claim 15 wherein said panels are sized such that when said panels are infolded to said closed condition, said container is substantially sealed.

18. A container comprising an elongated strip of substantially planar material having opposed ends and elongated parallel edges, the opposed ends being joinable in a mutual overlapping relation; one of said elongated edges engaging a sealing closure and an opposite one of said elongated edges has a border having a first crease line extending substantially parallel to said edges, a plurality of crease lines extending perpendicular thereto and extending to the one of said elongated edges defining a plurality of adjoining panels, each of said adjoining panels having an oblique crease line extending from the first crease line and one of the perpendicularly extending crease lines, parting off a triangular edge element, said border has a second crease line extending substantially parallel to said first crease line defining a narrow inner band adjoining said panels, said second crease line defines a reinforced lip about a mouth of said container when said border is folded inwardly and outwardly about said second and first crease lines, respectively, said panels being recessed from said mouth and foldable and unfoldable simultaneously over each other between an open condition and a closed condition, wherein said panels, upon being pressed inwardly, collectively lock in place.

19. The container as claimed in claim 18 wherein said container has N panels, wherein N is an integer number, and said triangular edge element has an apex angle of 360/(2N) +X, wherein X is in the range of about 2° to 5°.

20. The container as claimed in claim 19 wherein N is between 6 and 12, inclusive.

21. The container as claimed in claim 20 wherein X is 2°.

22. The container as claimed in claim 18 wherein said panels are sized such that when said panels are folded to said closed condition, a central aperture is presented.

23. The container as claimed in claim 18 wherein said panels are sized such that when said panels are infolded to said closed condition, said container is substantially sealed.

24. The container as claimed in claim 18 wherein said border has a pull tab extending from the one edge of the strip to facilitate opening of the closure.

* * * * *